US005803792A

United States Patent [19]

Roush et al.

[11] Patent Number: 5,803,792

[45] Date of Patent: Sep. 8, 1998

[54] ANTI-SLIPPING BRASSIERE STRAP BRIDGING AND SUPPORT MEMBER

[76] Inventors: Warren H. Roush; Anne F. Roush, both of 400 Flint Lock Dr., SE., Dacula, Ga. 30211-1493

[21] Appl. No.: 754,885

[22] Filed: Nov. 20, 1996

Related U.S. Application Data

[63] Continuation-in-part of Ser. No. 569,675, Dec. 8, 1995.

[51] Int. Cl.[6] ..... A41D 27/26

[52] U.S. Cl. ..... 450/86; 2/73; 2/267; 2/268

[58] Field of Search ..... 2/2.5, 73, 267, 2/268, 107, 117, 101, 406, 300, 302, 305, 310, 311, 312, 317, 318, 319, 336, 338, 2; 224/264; 450/86, 102, 103, 104

[56] References Cited

U.S. PATENT DOCUMENTS

| | | |
|---|---|---|
| 1,631,694 | 6/1927 | Rick . |
| 2,501,749 | 3/1950 | Trent . |
| 2,505,272 | 4/1950 | Blalock et al. . |
| 2,551,255 | 5/1951 | Engel . |
| 2,608,326 | 8/1952 | Spector . |
| 3,046,991 | 7/1962 | Heberling . |
| 3,050,734 | 8/1962 | Dopyera . |
| 3,788,314 | 1/1974 | Noreen . |
| 4,354,280 | 10/1982 | Hayes . |
| 4,441,211 | 4/1984 | Donzis . |
| 4,472,838 | 9/1984 | Pompa . |
| 4,612,935 | 9/1986 | Greifer . |
| 4,638,513 | 1/1987 | Woods . |
| 4,764,988 | 8/1988 | Reaver . |
| 4,795,399 | 1/1989 | Davis . |
| 4,795,400 | 1/1989 | Greenberg . |
| 4,945,576 | 8/1990 | Melton . |
| 5,474,487 | 12/1995 | Roush . |

FOREIGN PATENT DOCUMENTS

| | | |
|---|---|---|
| 1118197 | 3/1956 | France . |
| 2321906 | 4/1993 | Germany . |
| 521222 | 5/1940 | United Kingdom . |

*Primary Examiner*—Jeanette E. Chapman
*Attorney, Agent, or Firm*—Hinkle & Associates, P.C.

[57] ABSTRACT

An anti-slipping support for a brassiere shoulder strap 5 has a pliant, elongate bridge plate 1 with a curvature. An upper surface 6 of the bridge plate has a groove 9 proximate an elongate axis. The groove has a securing surface that can be smooth, textured or have a plurality of protrusions 11, each having a gripping surface 12, extending therefrom. A pliant flap 13 is mounted to the upper surface. The respective brassiere shoulder strap is positioned within the groove and beneath the flap to secure the bridge plate from movement along the strap and to provide a smooth top surface. A lower surface of the bridge plate is provided with a cushion pad, which can be either permanently mounted or detachable from the bridge plate. Ventilation orifices 23 can be provided in the bridge plate. Another embodiment has a pair of spaced apart T-shaped strap bays 37 respectively located proximate first and second ends 2 and 3 of the bridge plate to receive the respective brassiere shoulder strap.

21 Claims, 4 Drawing Sheets

ANTI-SLIPPING BRASSIERE STRAP BRIDGING AND SUPPORT MEMBER

This application is a continuation-in-part of copending application Ser. No. 08/569,675 filed on Dec. 8, 1995.

BACKGROUND OF THE INVENTION

1. Field of the Invention

The present invention relates generally to the field of brassiere straps and more particularly to a weight-distribution and cushioning support which resists slipping on the brassiere straps and protects women's shoulders against discomfort and injury from suspension of weight of breasts by brassiere shoulder straps.

2. Description of the Related Art

Support of medium-to-large sized breasts by brassiere straps has caused problems of disfigurement of shoulder tissues, unsightly appearance, discomfort and occasional injury since the advent of brasseries. Wide brassiere straps do not always solve the problem because they do not distribute weight evenly over wide areas. Various forms of padding have been devised, but have not become popular for a number of reasons. Some forms of padding are designed for ease of application to the brassiere straps, but do not remain securely in a fixed location on the straps as the woman moves her shoulder. Others are designed to remain securely in place on the brassiere straps, but either require a modified strap for use or are destructive to the brassiere straps by the means of attachment. Further, some forms of these padding devices do not provide a smooth surface against an outer garment rendering them detectable, unattractive and not feminine enough for most use conditions.

A shoulder guard described in U.S. Pat. No. 2,551,255 by Engel has a longitudinal body with a longitudinal recess proportioned to receive a strap. The brassiere strap is held between transverse slots at each end of the longitudinal recess. This devise utilizes a clamping action against the strap to hold it in place which places stress upon the brassiere strap.

U.S. Pat. No. 2,505,272 granted to Blalock et al describes a saddle for brassiere straps which has a pad fixed to a top portion. Its strap-attachment method requires snap fasteners to be installed on the brassiere straps and then snapped on the upper surface of the saddle. In addition to the modification of the brassiere straps, this devise does not have a smooth upper surface.

A shoulder pad and brassiere strap cushion apparatus described in U.S. Pat. No. 4,945,576 by Melton has two portions. The brassiere strap is disposed on one portion, and the other portion is folded over and secured to the one portion by "Velcro" looped and hooked fasteners. When folded, this devise is relatively thick, has a flat surface and has an enhanced wearing action by the "Velcro" fasteners on the brassiere straps.

U.S. Pat. No. 3,050,734 granted to Dopyera also describes a shoulder-strap pad which has a cushioned bottom fixed to a top portion. Its strap-attachment method has strap holders located on the upper surface of the pad and a ridge means to hold the shoulder-strap in place across the top of the pad. The Dopyera devise is designed for the straps of recreational equipment, rather than being amenable to aesthetic uses by women with breasts large enough to require firm support.

A shoulder guard described in U.S. Pat. No. 3,046,991 by Heberling has a flat base portion having channel shaped side portions with a series of projections extended from the longitudinal center of the base portion. The projections coordinate with brassiere straps having openings spaced in a similar, mating arrangement to the projection spacing. In addition to the required modification of the brassiere straps, this devise does not have a flat upper surface.

A strap-bearing pad described in U.S. Pat. No. 4,795,399 by Davis has a top rigid layer and a bottom soft layer. A brassiere strap is held between pairs of tabs at each end on the upper surface. This devise does not provide a secure means to prevent the brassiere strap from slipping, nor does it provide a smooth upper surface. This devise is relatively thick and limited to athletic and nursing uses.

In our U.S. Pat. No. 5,474,487, a brassiere-shoulder-strap support is described having a pliant bridge plate, a detachable cushion and T-shaped strap bays. This device is effective for weight distribution, but the T-shaped strap bay does not completely prevent sliding of the support on the brassiere strap, especially when the woman moves her shoulder. Additionally, because the brassiere strap is disposed across a top surface of the brassiere-shoulder-strap support, the strap is visible from outside of the woman's clothing and renders an unsightly appearance.

SUMMARY OF THE INVENTION

In accordance with the present invention, it is contemplated that the problems that have existed and that continue to exist in this field, objectives of this invention are to provide an anti-slipping brassiere-shoulder-strap support which:

- Has a cushion pad that can be cleaned;
- Has a curvature which form-fits a woman's shoulder beneath a brassiere strap and will not restrict circulation of blood in the upper torso of the wearer;
- Has a rigid bridge that is sized and shaped to extend sufficiently rearward from proximate the clavicle bone and over a sufficiently wide area to distribute weight of breasts held by the brassiere strap without cutting into, indenting or injuring shoulder, skin and bone tissues;
- Prevents pain and discomfort due to excessive brassiere-strap pressure;
- Allows leaving brassiere-shoulder strap supports on a brassiere when it is not being worn in order to use them fast and conveniently without reattachment when a brassiere is worn again;
- Makes brassiere straps easily and conveniently attachable and removable, and is not destructive to the straps as are other devices utilizing harsh attachment means, such as hook and loop fastening devices;
- Has cushion pads with a variety of thicknesses and widths for different conditions and uses with ease by women with different physical characteristics;
- Allows use of more rigid and supportive brassiere straps without irritation, indentation, pain or injury;
- Allows use of cushion pads which are selectively hypo-allergenic and will not cause allergic skin reactions;
- Prevents slippage of brassiere straps from shoulders;
- Allows transfer of anti-slipping brassiere-shoulder-strap supports from one brassiere to another easily and conveniently;
- Has both rigidly-bridging and effectively-cushioning components which can be designed especially for athletic and nursing applications without redesign of brasseries for different levels of breast-weight support and physical activity;

Has a smooth upper surface for aesthetic uses; and which

Prevents slippage of the brassiere-shoulder-strap support upon the brassiere strap.

This invention accomplishes the above and other objectives with an anti-slipping brassiere-shoulder-strap support having a pliant, elongate bridge plate with a curvature sized and shaped to form-fit on a woman's shoulder beneath a brassiere strap between an area proximate the clavicle bone in the front and a position proximate a downward-curving rear portion of the shoulder. The elongate bridge plate can be shaped variously, preferably having a generally elliptical form. A lower surface of the bridge plate is provided with a cushion pad and held in cushioning relationship between the bridge plate and the woman's shoulder. One embodiment of the invention has the cushion pad permanently mounted to the bottom surface of the bridge plate. Another embodiment of the invention has the cushion pad attached to and detached from the bridge plate conveniently and easily for cleaning, servicing and replacement. Cushion pads with different thicknesses, widths and other characteristics can be provided and utilized optionally and interchangeably for different levels of breast-weight and physical activity of users. An upper surface of the bridge-plate has a groove proximate the elongate axis to receive the brassiere strap. The groove has a securing surface and optionally has a plurality of protrusions extending therefrom. Also optionally disposed within and at each end of the groove are T-shaped strap bays to receive the brassiere strap. Each protrusion has a gripping surface which grips the brassiere strap to nondestructively resist movement of the support along the strap. A pliant flap is mounted to the upper surface of the bridge plate that at least extends across the groove. A given shoulder strap of a brassiere is positioned within the groove and beneath the flap, whereby the flap exerts pressure upon the strap and causes the strap to engage the gripping surfaces of the protrusions. The pressure exerted by the flap secures the bridge plate from movement along the strap. Also, the flap provides an aesthetically pleasing smooth top surface. Orifices for ventilation can be provided in the bridge plate. Further, the present invention provides a support for the brassiere strap which is feminine, sleek, unobtrusive in use and secure from movement upon the brassiere strap.

Other objects, advantages and capabilities of the invention will become apparent from the following description taken in conjunction with the accompanying drawings showing preferred embodiments of the invention.

DESCRIPTION OF THE PREFERRED EMBODIMENTS

Figure 1:
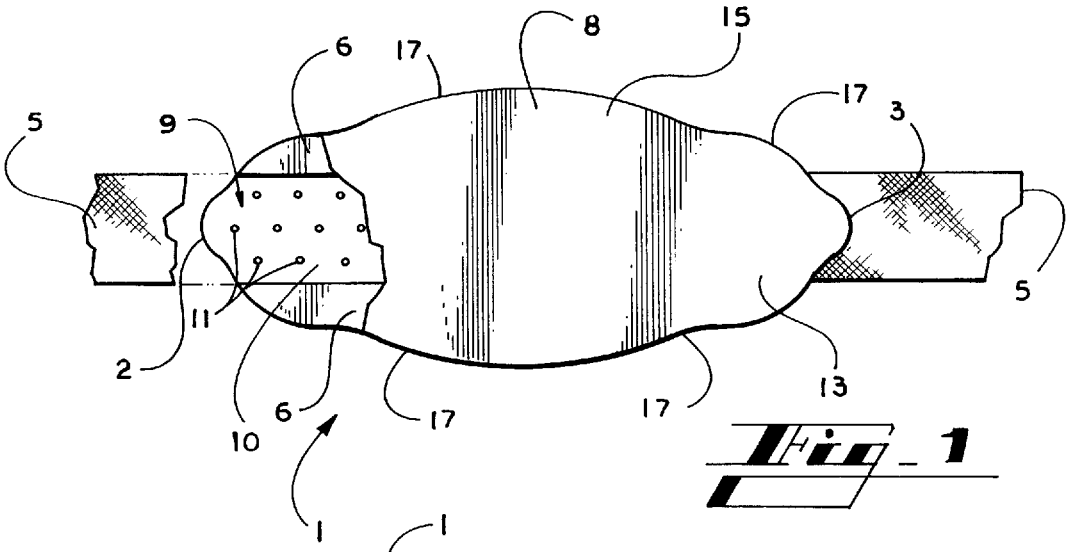
FIG. 1 is a top view of one embodiment of an anti-slipping brassiere-shoulder-strap support with a brassiere strap attached and cut away in part to show a groove and protrusions without showing a cushion pad beneath it.
Figure 2:
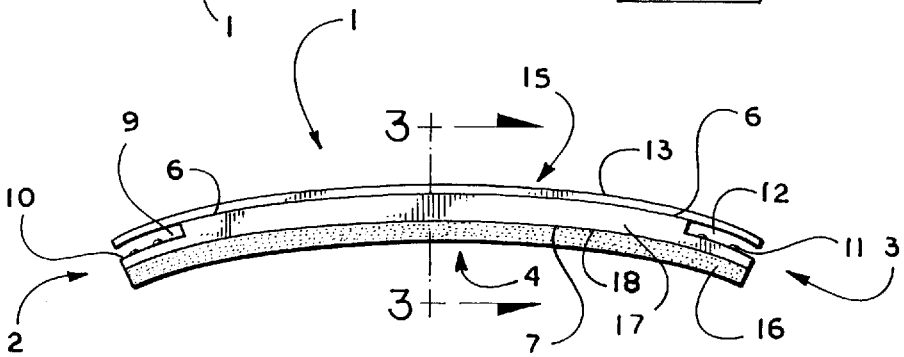
FIG. 2 is a side elevation view of the embodiment of FIG. 1 showing a flap, a bridge plate and a cushion pad assembled.

Referring to the drawings wherein like reference numerals designate corresponding parts throughout the several figures, reference is made first to FIG. 1. An anti-slipping brassiere-shoulder-strap support has a pliant bridge plate 1 with a first end 2, a second end 3 and an elongate curvature 4. The elongate curvature of the bridge plate 1, as shown in FIG. 2, is designed to conform to a portion of a woman's shoulder between a position proximate a clavicle bone and a top-rear portion of the woman's shoulder. The bridge plate 1 is sized and shaped to form-fit the top of the woman's shoulder under a brassiere shoulder strap 5. It is referred to as a bridge plate 1 because it distributes weight from a brassiere strap evenly over a broad portion of the woman's shoulder in a uniform manner like a bridge. The bridge plate 1 is constructed preferably from a light plastic material that is sufficiently rigid to distribute such weight evenly and yet resilient in response to anticipated movement of the woman's shoulder.

Figure 5:
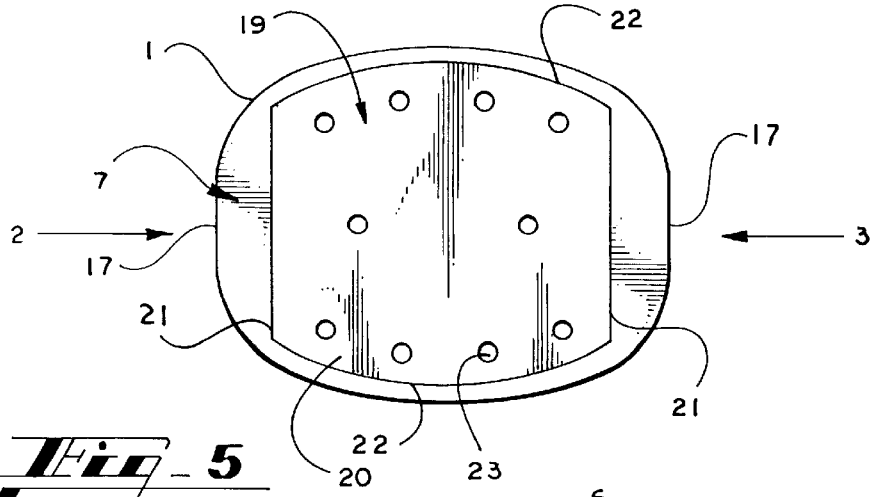
FIG. 5 is a bottom view of another embodiment of a bridge plate without a cushion pad in the cushion receptacle.

Shape of the bridge plate 1 is preferably elongate with a modified elliptical form. Other elongate shapes also can be employed, as shown in FIG. 5. Length of the bridge plate 1 is sufficient to extend from desired proximity to the clavicle bone to desired proximity to a top-rear portion of the woman's shoulder. The size and the length-to-width proportions can vary considerably for different women and for different use conditions. Large, medium and small sizes of the bridge plate are foreseeable. The bridge plate 1 has a width greater than a width of the brassiere shoulder strap 5.

Thickness of the bridge plate 1 also can be different for different women and for different use conditions. Different sizes can be constructed with different thicknesses.

Figure 3:
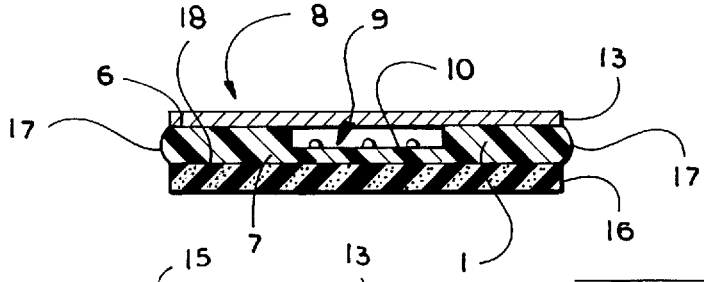
FIG. 3 is a is a vertical section view taken along line 3—3 of FIG. 2.
Figure 4:
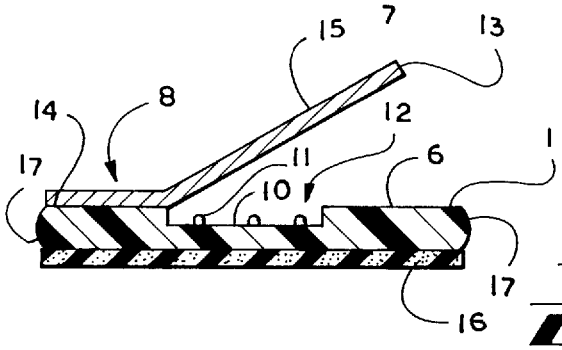
FIG. 4 is a vertical section view taken along line 3—3 of FIG. 2 with the flap raised.

Referring now to FIGS. 1 through 3, the bridge plate 1 has an upper surface 6, a lower surface 7 and a bonding side 8. Located on the upper surface 6 is a groove 9 proximate an elongate axis between the first end 2 and the second end 3 of the bridge plate 1. The groove has a securing surface 10, and although not required, this embodiment has a plurality of protrusions 11 extending from the securing surface 10. Each protrusion 11 has a gripping surface 12 distally located from the securing surface 10.

As shown in FIGS. 1 through 4, a pliant flap 13 having a bonding surface 14 and a top surface 15 is mounted at the bonding surface 14 thereof to the upper surface 6 of the bridge plate 1 on the bonding side 8. The flap 13 can be mounted to the bridge plate 1 by use of an adhesive, an epoxy, a fusion method or any conventional means. It is also foreseeable that the bridge plate 1 and the flap 13 can be formed as a single unit. In order to attach the anti-slipping brassiere-shoulder-strap support to the brassier shoulder strap 5, the flap 13 is manually raised, the strap 5 is slid between the flap 13 and the bridge plate 1 into the groove 9 and the flap 13 is released, whereby the flap 13 exerts pressure upon the strap 5 and engages the strap 5 with the gripping surfaces 12 of the protrusions 11. The protrusions 11 have a designed height to firmly engage the gripping surfaces 12 with the brassiere shoulder strap 5 without distorting the smooth top surface 15 of the flap 13.

A cushion pad 16 can be attached to the lower surface 7 of the generally concave bridge plate 1. This support for the brassiere shoulder strap 5 is comprised primarily of the bridge plate 1 and the cushion pad 16. The bridge plate 1 distributes weight over a wide area and the cushion pad 16 softens contact between the woman's shoulder and the bridge plate 1. In order to eliminate discomfort from sharp edges gouging the woman's shoulder, the bridge plate 1 has a peripheral edge 17 that is rounded.

Thickness of the cushion pad 16 depends to a great extent on its resilient resistance to collapse or softness. Different levels of softness are preferred for different women and for different use conditions.

Material for construction of the cushion pad 16 has several preferred characteristics or specifications. It can be washed easily without retaining adverse odors or colors. It does not wear out soon from being washed and replaced often in the same or different brasseries. It has a resiliency which is sufficient to bear weight placed on the bridge plate 1 without collapsing to where the bridge plate 1 comes in contact with the woman's shoulder. The resiliency does not diminish with repeated washing and wearing throughout its use life. It has relatively "non-skid" contact with skin on the woman's shoulder to prevent it and the brassiere strap on it from sliding off the woman's shoulder.

Referring to FIG. 2, the cushion pad 16 has an attachment side 18 which is permanently affixed to the lower surface 7 of the bridge plate 1. This can be accomplished by fusing or adhesively attaching the attachment side 18 of the cushion pad 16 to the lower surface 7 of the bridge plate 1. In the preferred embodiment, the cushion pad 16 is first placed in a mold and the light plastic material is then injected into the mold fusing the bridge plate 1 to the cushion pad 16.

Another embodiment, as shown in FIG. 5, has a cushion receptacle 19 in the concave lower surface 7 of the bridge plate. The cushion receptacle 19 has a receptacle bottom 20, receptacle end walls 21 and receptacle side walls 22. Ventilation orifices 23 extend into the cushion receptacle 19. The cushion pad 16 is removably placeable in the cushion receptacle 19. The receptacle end walls 21 are proximate the first end 2 and the second end 3 of the bridge plate 1.

Figure 6:
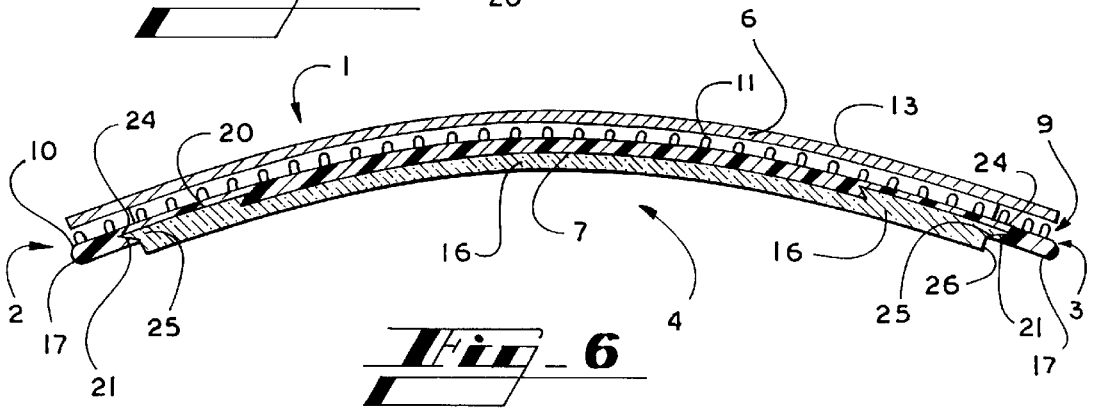
FIG. 6 is an enlarged side view that has been cut away in part to show portions of a cushion pad inside and outside of a cushion receptacle.

In FIG. 6 there is shown at least two walls of the cushion receptacle, preferably receptacle end walls 21, having retainer recesses 24. Pad dovetail walls 25 are sized and shaped to fit against the retainer recesses 24 in dovetail-interlocking relationship.

Figure 7:
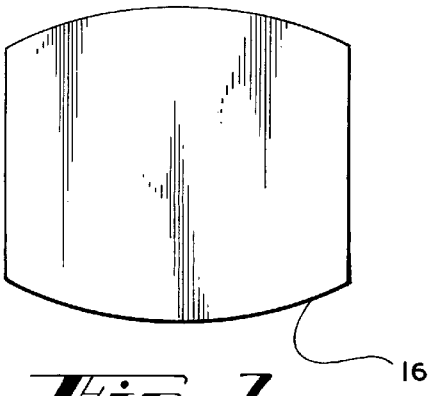
FIG. 7 is a bottom view of a cushion pad without vent orifices that is separate from the bridge plate.
Figure 8:
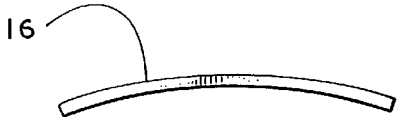
FIG. 8 is a side elevation view of the FIG. 7 illustration.
Figure 9:
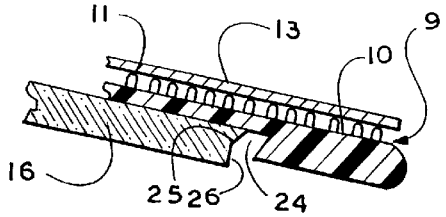
FIG. 9 is an enlarged sectional view of a cushion pad of the type shown in FIG. 6 that is partly separated from the bridge plate.
Figure 10:
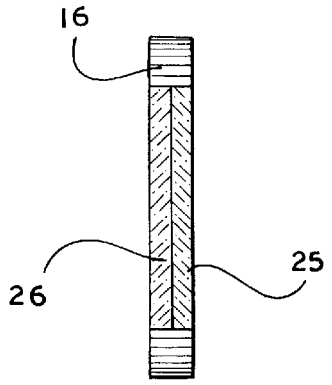
FIG. 10 is a separate end elevation view of the cushion pad that is shown in FIGS. 7–9.

Referring to FIGS. 7 through 10, the cushion pad 16 is shown separately in FIG. 7 from the bottom, in FIG. 8 from the side and in FIG. 10 from an end. In FIG. 9, the pad dovetail wall 25 is shown separated from the retainer recess 24. A cushion boss 26 is shown in FIGS. 9 and 10 as a portion of the cushion pad 16 which extends beyond the bridge plate 1 in contact with the woman's shoulder.

Figure 11:
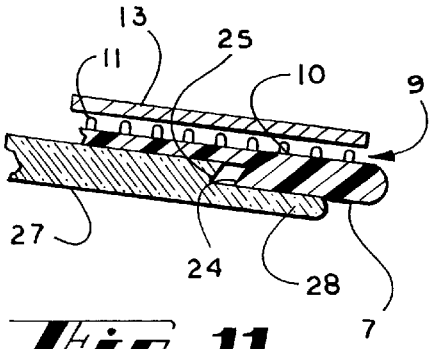
FIG. 11 is an enlarged sectional view of a another cushion pad of the type shown in FIG. 6 that is partly separated from the bridge plate.
Figure 12:
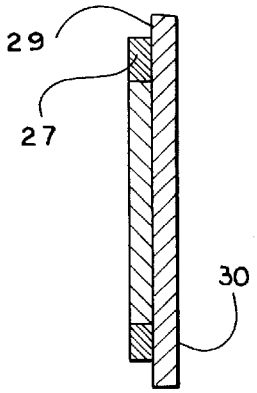
FIG. 12 is an end view of the cushion pad shown in FIG. 11.

In FIGS. 11 and 12, a full-bottom cushion pad 27 has overlap end sections 28 and overlap side sections 29 extending beyond receptacle end walls 21 and receptacle side walls 22, respectively. A bottom 30 of a full-bottom cushion pad 27 can be made to cover an entire lower surface 7 (see FIGS. 5 and 6) of the bridge plate 1. The full-bottom cushion pad 27 is shown separately from an end in FIG. 12 and separated from the retainer recess 24 in FIG. 11. In FIG. 11, an overlap end section 28 is shown in slidable contact with a lower surface 7 of a bridge plate 1 as pad dovetail walls 25 are brought in contact with a retainer recess 24 for attaching the full-bottom cushion pad 27. For removing the full-bottom cushion pad 27 or the cushion pad 16, the pad dovetail walls 25 are removed from contact with the retainer recess 24 by grasping either cushion pad 16 or 27 and pulling it outwardly.

Either of the cushion pads 16 or 27 can be adhesively attached to the cushion receptacle 19 if desired. For adhesive attachment, characteristics of the adhesive employed are compatible with characteristics of the cushion pads. Preferably, both are washable and odor-resistant.

Figure 13:
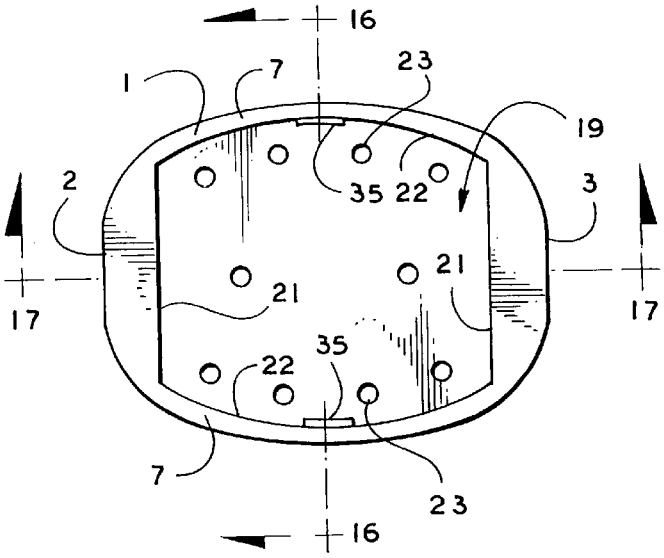
FIG. 13 is a bottom view of yet another embodiment of a bridge plate without showing the cushion pad beneath it.
Figure 14:
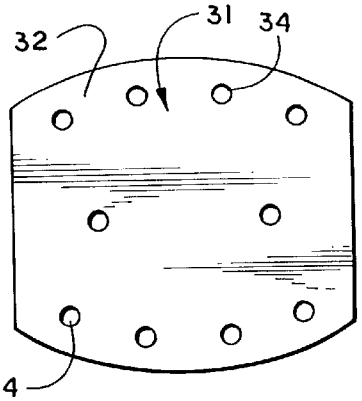
FIG. 14 is a top view of a cushion pad that fits the bridge plate shown in FIG. 13.
Figure 15:
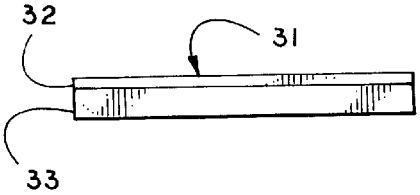
FIG. 15 is a side elevation view of the cushion shown in FIG. 14.

In yet another embodiment of the invention as shown in FIG. 13, the bridge plate 1 is shown in the same oval configuration. Looking at the bottom of the bridge plate 1, the cushion receptacle 19 holds a modified cushion pad 31 therein. FIGS. 14 and 15 show the modified cushion pad 31 comprising a two-part construction, namely, a hard, preferably plastic, backing material 32 and a softer foam cushion pad 33. The modified pad 31 preferably has therein a plurality of holes 34, matching the spacing of the vent orifices 23 of the bridge plate 1, to provide ventilation.

Figure 16:
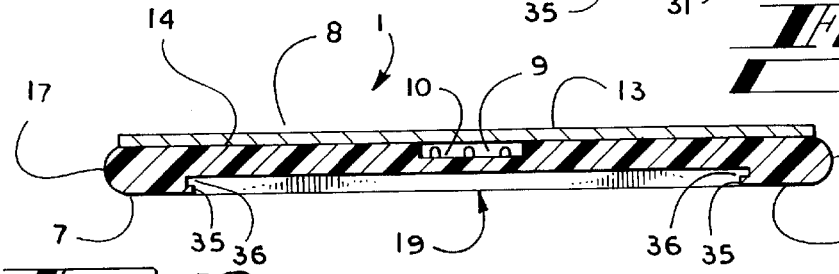
FIG. 16 is a vertical section view taken along lines 16—16 of FIG. 13.
Figure 17:
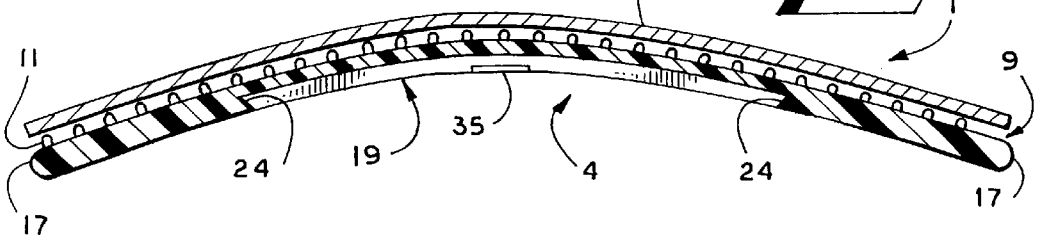
FIG. 17 is a vertical section view taken along lines 17—17 of FIG. 13.

The bridge plate 1 of FIG. 13 has retainer recesses 24 at the receptacle end walls 21 of the first and second ends 2 and 3, respectively. On the receptacle side walls 22 of the bridge plate 1 are one or more retainer gripping tabs 35 which project inwardly from the rim of the bridge plate 1 along the receptacle side walls 22. As more readily seen in the vertical cross-sections in FIGS. 16 and 17, the retainer gripping tabs 35 form a retainer space 36 between the tabs 35 and the cushion receptacle area 19. The retainer space 36 operates to engage an edge of the backing material 32 of the modified cushion pad 31 within the retainer space 36 so that the modified cushion pad 31 is not only held on the ends of the plate by means of the retainer recesses 24, but is also snapped into firm engagement with the plate by means of the retainer gripping tabs 35.

Figure 18:
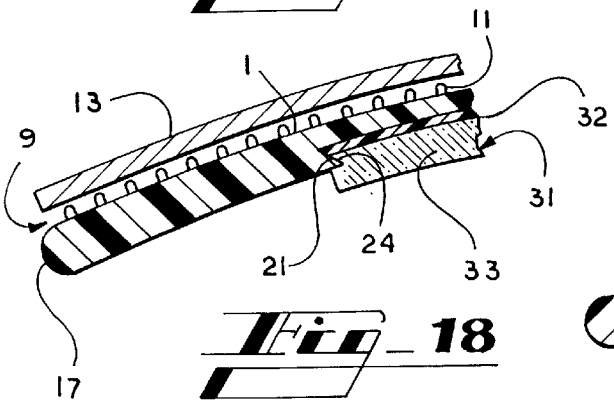
FIG. 18 is a partial vertical section view taken along lines 17—17 of FIG. 13 showing the cushion pad of FIG. 14 placed in the bottom of the bridge plate.
Figure 19:
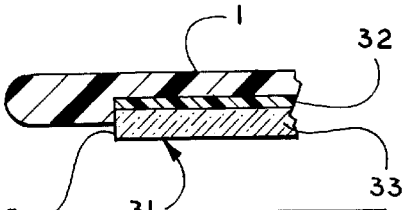
FIG. 19 is a partial vertical section view taken along lines 16—16 of FIG. 13 showing the cushion pad of FIG. 14 placed in the bottom of the bridge plate.

Therefore, as can be seen in FIG. 18, at the ends of the bridge plate 1, the modified cushion pad 31 is snapped into the retainer recesses 24 and the receptacle end walls 21 hold the backing material 32 and engage the soft foam cushion pad 33 to maintain firm engagement on the ends of the bridge plate 1. As can be seen in FIG. 19, the modified cushion pad 31 is maintained in the bridge plate 1 by engagement of the retainer gripping tabs 35 with the backing material 32, and the retainer gripping tabs 35 also engage the cushion pad 33. It can be seen that with this particular arrangement that there is little chance, if any, that the modified cushion pad 31 will be dislodged by activities of the person wearing the bridge plate 1. To mount the modified cushion pad 31 into the bridge plate 1, it is merely necessary to place the modified cushion pad 31 over the cushion receptacle area 19, press upon each end to snap the backing material 32 under the retainer recesses 24 and then press the side edges of the modified cushion pad 31 to snap the backing material 32 under the retainer gripping tabs 35.

It is contemplated that all materials utilized in a bridge plate 1, and the various cushion pads disclosed herein, will be of medical grade materials and be non-hypo-allergenic.

Figure 20:
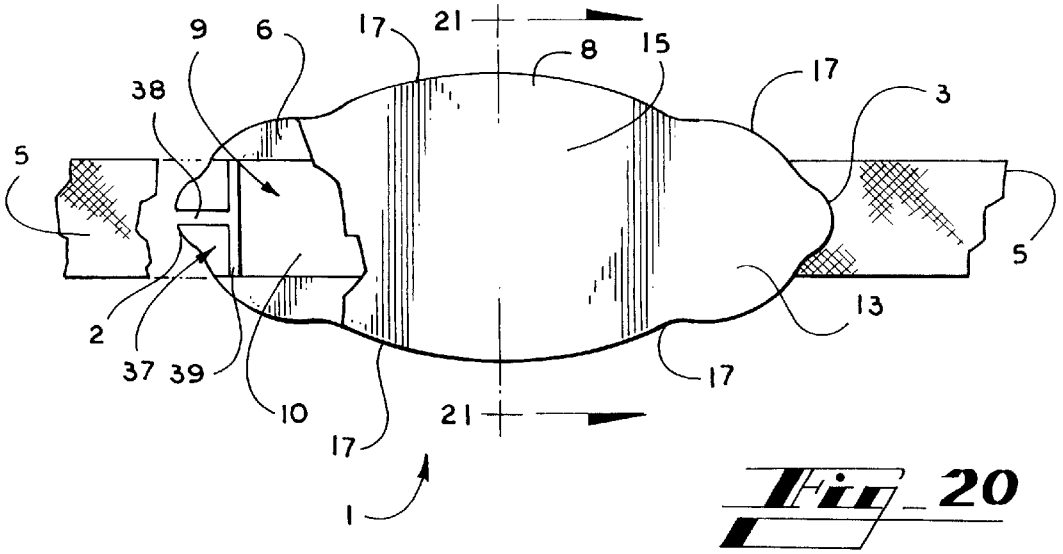
FIG. 20 is a top view of still another embodiment of the anti-slipping brassiere-shoulder-strap support with the brassiere strap attached and cut away in part to show the groove having a smooth securing surface and a T-shaped strap bay.
Figure 21:
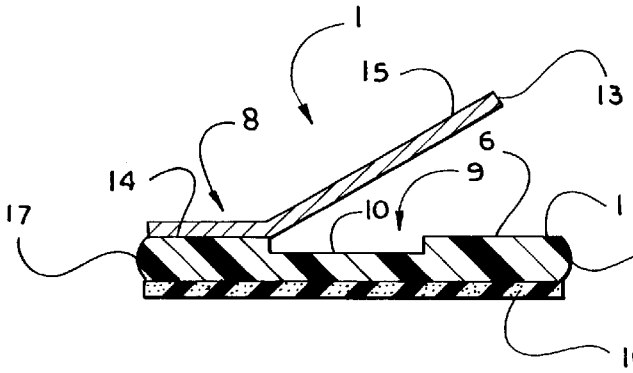
FIG. 21 is a vertical section view taken along line 21—21 of FIG. 20 with the flap raised.

Still yet another embodiment of the invention is shown in FIGS. 20 and 21. This embodiment has the shape, although not required, of the embodiment shown in FIG. 1 and can have the features of the previous embodiments. A notable difference in this embodiment is that the groove 9 has a pair of spaced apart T-shaped strap bays 37 located proximate the first and second ends 2 and 3, respectively, to receive the brassiere shoulder strap 5. Each T-shaped strap bay 37 has a strap entrance section 38 that is substantially parallel to the elongate axis of the bridge plate 1 and a strap-container section 39 that is substantially perpendicular to the strap-entrance section 38. The brassiere shoulder strap 5 is slid in sideways through the strap-entrance section 38 and then turned parallel to be located within the strap-container section 39. Referring to the groove 9, the securing surface 10 is shown as being smooth without the protrusions 11. The securing surface 10 may also be textured with any type of raised surface that extends outwardly from the securing surface 10. Such raised surface may be knurled, ribbed, circled, patterned and the like.

Various modifications may be made of the invention without departing from the scope thereof and it is desired, therefore, that only such limitations shall be placed thereon as are imposed by the prior art and which are set forth in the appended claims.

What is claimed is:

1. An anti-slipping brassiere-shoulder-strap support comprising:

a pliant bridge plate having a first end, a second end and an elongate curvature which conforms to a portion of a woman's shoulder between a position proximate a clavicle bone and a top-rear portion of the woman's shoulder, the bridge plate having an upper surface, a lower surface and a bonding side, a bridge plate width greater than a width of a brassiere shoulder strap that is placeable on the bridge plate, a cushion pad on the lower surface of the bridge plate to be placeable on the woman's shoulder in cushioning relationship between the bridge plate and the woman's shoulder, a mounting means to affix the cushion pad to the lower surface of the bridge plate, a groove proximate the elongate axis between the first end and the second end of the bridge plate and on the upper surface of the bridge plate, the groove having a securing surface, and a pliant flap having a top surface and a bonding surface, the bonding surface of the flap mounted to the upper surface of the bridge plate on the bonding side, whereby the flap exerts pressure upon the strap and engages the strap with the securing surface of the groove to secure the bridge plate from movement along the strap and to provide a smooth top surface.

2. A brassiere-shoulder-strap support as claimed in claim 1, wherein:

the pliancy of the bridge plate being sufficient to distribute weight selectively over a portion of the woman's shoulder to which the elongate curvature of the bridge plate conforms and to prevent bending of the bridge plate by a bending moment applied by movement of the shoulder by the woman, thickness and compressive resistance of the cushion pad being of sufficient resistance to collapse of the cushion pad to prevent the cushion pad from collapsing from weight supported by the brassiere strap, and the cushion pad being constructed of resilient material which is cleanable without loss of resiliency, shape and structural integrity.

3. A brassiere-shoulder-strap support as claimed in claim 1, further comprising the bridge plate having a peripheral edge, the peripheral edge being rounded.

4. A brassiere-shoulder-strap support as claimed in claim 1, further comprising vent orifices in the bridge plate, the cushion pad and the flap.

5. A brassiere-shoulder-strap support as claimed in claim 1, wherein the mounting means comprises the cushion pad having an attachment side, the attachment side being fused to the lower surface of the bridge plate.

6. A brassiere-shoulder-strap support as claimed in claim 1, wherein the mounting means comprises the cushion pad having an attachment side, the attachment side having an adhesive placed thereon, the cushion pad being adhesively attached to the lower surface of the cushion receptacle.

7. A brassiere-shoulder-strap support as claimed in claim 1, wherein the mounting means comprises a cushion receptacle having multiple receptacle walls and a bottom surface, said walls further extending from the lower surface of the bridge plate to and intersecting with the bottom surface of the cushion receptacle, one receptacle wall of the cushion receptacle is recessed at an end of the cushion receptacle that is proximate the first end of the bridge plate and another receptacle wall of the cushion receptacle is recessed at an end of the cushion receptacle that is proximate the second end of the bridge plate, the cushion pad removably placeable in the cushion receptacle, a receptacle side of the cushion pad is placeable on a bottom surface of the cushion receptacle, edges of the cushion pad are positioned in contact with the receptacle walls of the cushion receptacle and a cushion side of the cushion pad is extended from the cushion receptacle past the lower surface of the bridge plate, and the cushion pad sized and shaped to be positioned in contact with the recessed walls of the cushion receptacle in dovetail-interlocking relationship to hold the cushion pad in the cushion receptacle.

8. A brassiere-shoulder-strap support as claimed in claim 7, wherein the cushion pad has beveled edges on opposite ends thereof, the beveled edges are placed in a dovetail-interlocking relationship with recessed opposite ends of the cushion receptacle proximate the first and second ends of the bridge plate.

9. A brassiere-shoulder-strap support as claimed in claim 7, wherein the cushion pad has an attachment side, the attachment side having an adhesive placed thereon, the cushion pad being adhesively attached to the bottom surface of the cushion receptacle.

10. A brassiere-shoulder-strap support as claimed in claim 7, wherein the cushion pad is extended laterally and perpendicularly from the cushion receptacle such that the cushion pad is placed in juxtaposition with the receptacle walls.

11. A brassiere-shoulder-strap support as claimed in claim 7, wherein the cushion pad is extended laterally and perpendicularly from the cushion receptacle such that the cushion pad covers the receptacle walls and covers the bottom surface of the cushion receptacle.

12. A brassiere-shoulder-strap support as claimed in claim 1, wherein the mounting means comprises a cushion receptacle having at least first and second receptacle walls and a bottom surface, the first and a second said receptacle walls are recessed, said receptacle walls extending from the lower surface of the bridge plate to the bottom surface of the cushion receptacle, a cushion pad removably placeable in the cushion receptacle, the first and second receptacle walls being located proximate to respective first and second ends of the bridge plate, a receptacle side of the cushion pad placeable on the bottom surface of the cushion receptacle, edges of the cushion pad positioned in contact with the receptacle walls of the cushion receptacle, a cushion side of the cushion pad extended from the cushion receptacle past the lower surface of the bridge plate, and beveled edges on opposite ends of the cushion pad that are sized and shaped to be positioned in contact with the recessed walls of the cushion receptacle in interlocking relationship to hold the cushion pad in the cushion receptacle.

13. A brassiere-shoulder-strap support as claimed in claim 12, wherein the cushion pad is extended laterally and perpendicularly from the cushion receptacle such that the cushion pad covers the receptacle walls of the cushion receptacle.

14. A brassiere-shoulder-strap support as claimed in claim 1, wherein the mounting means comprises the bridge plate further having a bottom surface, the bottom surface being co-extensive to the elongate curvature, the bottom surface having a cushion receptacle, the cushion receptacle having a pair of end walls and a pair of side walls, the end walls and the side walls extending from the lower surface of the bridge plate to and intersecting with the bottom surface of the bridge plate, the cushion pad removably placeable in the cushion receptacle, the cushion pad comprising a stiff top surface and a resilient bottom surface, and the cushion receptacle having means to retain the cushion pad therein, the cushion receptacle means comprising end wall gripping recesses and side wall gripping surfaces to grip the cushion pad to maintain the cushion pad within the receptacle in juxtaposition with the bottom surface of the bridge plate, the stiff top surface of the cushion pad adapted to be engaged with the recesses of the end walls and with the gripping surfaces of the side walls.

15. A brassiere-shoulder-strap support as claimed in claim 14, wherein the end walls of the cushion receptacle are recessed.

16. A brassiere-shoulder-strap support as claimed in claim 14, wherein the side walls of the cushion receptacle each have at least one gripping tab extending therefrom.

17. A brassiere-shoulder-strap support as claimed in claim 14, wherein the gripping tabs of the side walls project outwardly from the side walls to receive the stiff top surface of the cushion pad between the gripping tabs and the bottom surface of the bridge plate.

18. A brassiere-shoulder-strap support as claimed in claim 1, wherein the securing surface is smooth.

19. A brassiere-shoulder-strap support as claimed in claim 1, wherein the securing surface is textured.

20. A brassiere-shoulder-strap support as claimed in claim 1, wherein the securing surface has a plurality of protrusions extending from the securing surface, and each protrusion has a gripping surface to removably engage the strap.

21. A brassiere-shoulder-strap support as claimed in claim 1, further comprising a pair of spaced apart T-shaped strap bays, each T-shaped strap bay having a strap-entrance section substantially parallel to an elongate axis of the bridge plate and a strap-container section substantially perpendicular to the strap-entrance section of the T-shaped bay, one T-shaped strap bay being proximate the first end, and the other T-shaped strap bay being proximate the second end.

* * * * *